United States Patent [19]

Martin et al.

[11] Patent Number: 5,009,171

[45] Date of Patent: Apr. 23, 1991

[54] FEED DEVICE WITH FILLING HOPPER AND ADJOINING FEED CHUTE FOR FEEDING WASTE TO INCINERATION PLANTS

[75] Inventors: Johannes J. E. Martin; Walter J. Martin, both of Munich, Fed. Rep. of Germany

[73] Assignee: Martin GmbH fur Umweld-und Energietechnik, Munich, Fed. Rep. of Germany

[21] Appl. No.: 381,540

[22] Filed: Jul. 18, 1989

[30] Foreign Application Priority Data

Jul. 29, 1988 [DE] Fed. Rep. of Germany ..... 3825930

[51] Int. Cl.[5] ..... F23K 3/12; F23K 3/16

[52] U.S. Cl. ..... 110/109; 110/289; 110/291

[58] Field of Search ..... 110/289, 290, 291, 109

[56] References Cited

U.S. PATENT DOCUMENTS

| | | | |
|---|---|---|---|
| 1,267,439 | 5/1918 | Moore | 110/109 X |
| 1,400,766 | 12/1921 | Peebles | 110/109 |
| 1,413,428 | 4/1922 | Riley | 110/109 |
| 2,169,390 | 8/1939 | McCurdy | 110/109 X |
| 2,348,494 | 5/1944 | Peters | 110/109 |

FOREIGN PATENT DOCUMENTS

| | | | |
|---|---|---|---|
| 2538380 | 10/1977 | Fed. Rep. of Germany . | |
| 934991 | 8/1963 | United Kingdom | 110/109 |

*Primary Examiner*—Edward G. Favors
*Attorney, Agent, or Firm*—McAulay Fisher Nissen Goldberg & Kiel

[57] ABSTRACT

A feed device comprises a filling hopper, a feed chute and a plurality of feeding pistons arranged adjacent to one another on a feed table, each feeding piston carrying at least one retaining and compression body in the area of its front end. The retaining and compression bodies can be constructed as flat or cubic bodies, wherein the surface configuration can be shaped in the manner of a rectangle, triangle, arc, trapezoid, pyramid or cone frustum.

18 Claims, 2 Drawing Sheets

FEED DEVICE WITH FILLING HOPPER AND ADJOINING FEED CHUTE FOR FEEDING WASTE TO INCINERATION PLANTS

BACKGROUND OF THE INVENTION

1. Field of the Invention

The invention is directed to a feed device comprising filling hopper and adjoining feed chute, feeding pistons being provided at the lower end of the latter for conveying waste to an incineration plant.

2. Background Prior Art

Waste is an extremely heterogeneous combustible material which differs in composition, so that difficulties can occur when charging incineration plants. The difficulties are based on the fact that the waste, depending on its composition, slides easily in one instance and accordingly has the tendency to slide into the incineration plant from the filling hopper, but, in another composition, is bulkier and does not have a good sliding behavior. In spite of the fact that the manner of operation of the feeding pistons remains constant, this leads to different feed quantities which, in connection with the different thermal values of the waste, can lead to a sharply fluctuating release of heat and accordingly to a fluctuating thermal output of the incineration plant.

A primary object of the invention is to construct the feed device of the type described above in such a way that the waste is prevented from sliding through over the feeding pistons and a uniform feeding of the waste into the incineration plant is ensured.

This object is met by a feed device comprising a filling hopper and adjoining feed chute. Feeding pistons are provided at the lower end of the feed chute for conveying waste to an incineration plant. An arrangement of at least one retaining and compression body on at least one feeding piston prevents the waste quantity fed into the filling hopper from sliding away over the feeding pistons in an uncontrolled manner. In addition to this retaining function, it is also achieved that the waste is somewhat compressed by means of this retaining and compression body during the return stroke of the feeding pistons, so that a compression of the waste is achieved particularly when the waste is very loose, so that the density of the combustible material is increased and an improved metering of this pre-compressed waste is made possible by means of the next forward stroke of the feeding piston.

The retaining and compression bodies can be provided in the area of the front ends of the feeding pistons or directly at the front end of the feeding pistons. A plurality of retaining and compression bodies, which can either be arranged adjacent to one another or so as to be offset relative to one another, can be arranged on every feeding piston. However, it is also possible that the retaining and compression body of a feeding piston is constructed as a body extending along the entire width of the feeding piston.

The retaining and compression bodies of adjacent feeding pistons can be offset relative to one another or aligned with one another.

Different shapes of the retaining and compression bodies can be advantageous depending on the composition of the waste and as a function of the angle at which the waste mass flow moves on the feeding piston.

In a determined combination of these preconditions, a first advantageous construction for achieving the retaining and compression effect can consist in that the retaining and compression bodies comprise a steeply dropping flank toward the rear end of the feeding piston and a gradually dropping flank toward the front end of the feeding piston. Accordingly, it is achieved that the driving or entraining effect of these bodies on the loose waste lying on the feeding piston during the forward stroke of the feeding piston is less than the retaining and compression effect during the reverse stroke of the feeding piston.

In another combination of the preconditions mentioned above, it can be advantageous, according to another construction of the invention, if the retaining and compression bodies comprise a gradually dropping flank toward the rear end of the feeding piston and a steeply dropping flank toward the front edge of the feeding piston.

The retaining and compression bodies can be constructed as flat bodies arranged on edge having an outline which is rectangular, trapezoidal, triangular or arc-shaped as seen from the side. However, the retaining and compression bodies can also be shape in the manner of a pyramid, a pyramid frustum, a cone, cone frustum or a spherical shell.

The invention is explained in more detail in the following with the aid of the embodiment examples shown in the drawing in a schematic manner. The scope of the invention will be pointed out in the appended claims.

DESCRIPTION OF THE PREFERRED EMBODIMENTS

Figure 1:
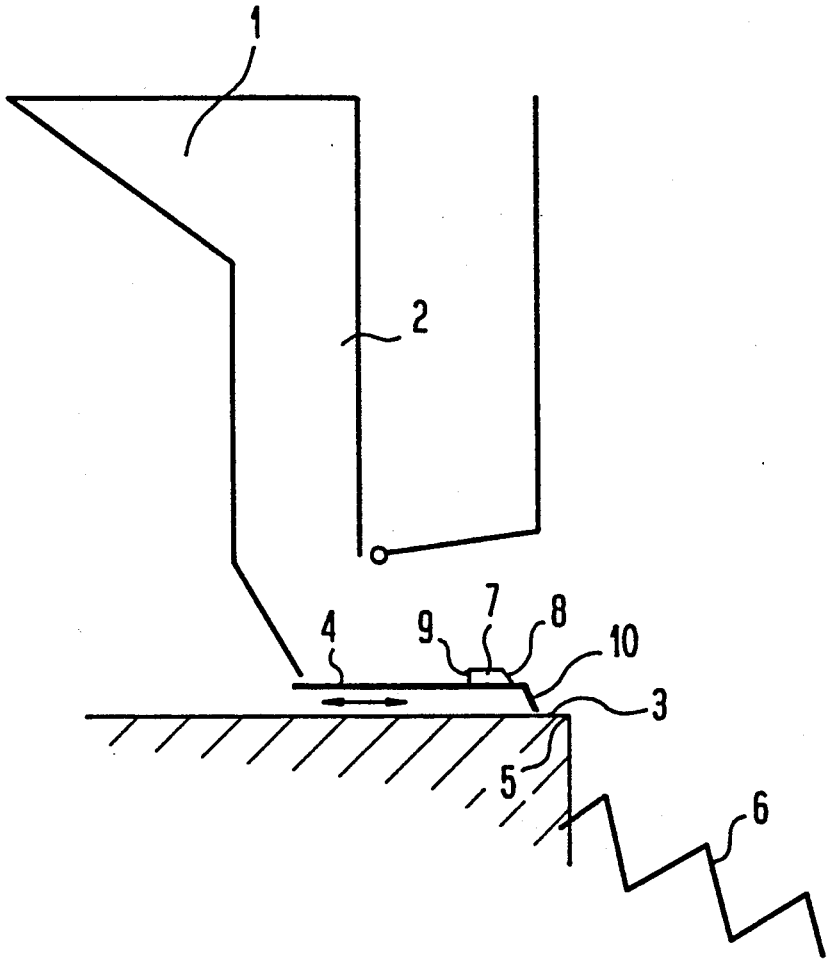
FIG. 1 shows a section through a feed device with feeding pistons.

As can be seen from FIG. 1, a feed device comprises a filling hopper 1, a feed chute 2 adjoining the latter, a feed table 3, and feeding pistons 4 which can be reciprocated on the feed table and push the waste, which is fed to the filling hopper 1 and slides down into the feed chute 2, to a grate 6 of an incinerator plant via the feeding edge 5.

Figure 2:
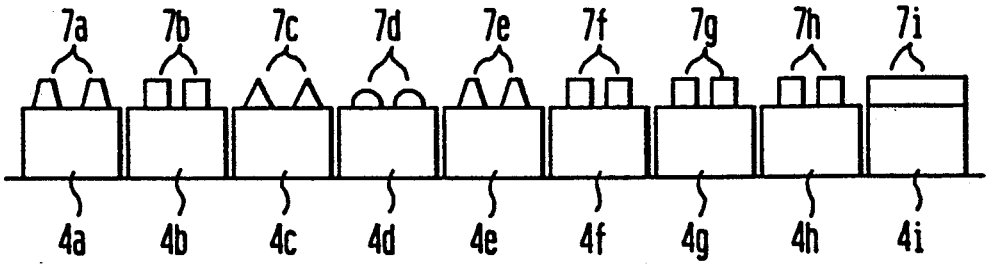
FIG. 2 shows a front view of the feeding pistons according to FIG. 1.
Figure 3:
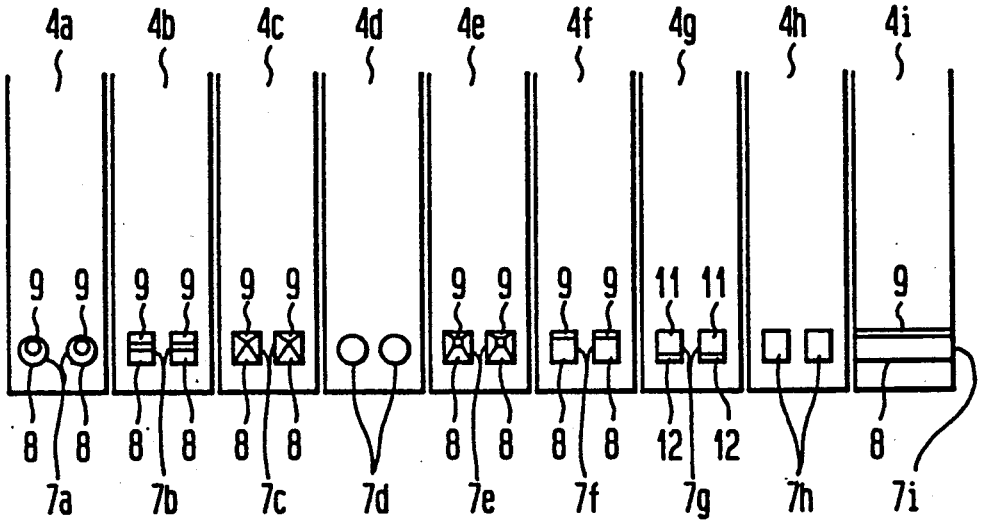
FIG. 3 shows a top view of the feeding pistons according to FIG. 2.

As can be seen in connection with FIGS. 2 and 3, retaining and compression bodies 7 are arranged on each feeding piston 4 in the front area of each feeding piston. Some of these retaining and compression bodies 7 comprise a gradually dropping flank 8 directed toward the front end of the feeding piston 4 and a steeply dropping flank 9 directed toward the rear end of the feeding piston 4. It is accordingly ensured that the piston conveys the waste predominantly by means of its front piston surface 10 during the forward stroke, that is, that it only pushes that waste in front of it which lies on the feed table 3, whereas two kinds of actions are to be achieved by means of the steep rear flank 9 of the retaining and compression bodies. The first action consists in that the waste sliding down in the feed chute 2 does not slide away over the feeding pistons 4 in an uncontrolled manner, and the second action consists in that the waste pressing downward is compressed during the return stroke by means of each retaining and compression body so as to be carried along only during the next piston stroke which is directed forward. A greater mass density of the waste, and accordingly of the combustible material, is achieved by means of the compression of the waste; moreover, the feed quantity is easier to regulate and is accordingly made uniform.

Some other retaining and compression bodies 7 comprise a steeply dropping flank 12 directed toward the front end of the feeding piston 4 and a gradually dropping flank 11 directed toward the rear end of the feeding piston 4. This can be advantageous if the feed chute is at a very steep angle to the feeding pistons, so that there is less risk of an uncontrolled sliding through, but the waste is relatively loose and must be subjected to a compression. The flank which drops gradually to the rear produces a compression component which is directed substantially opposite to the waste which is sliding down, so that the waste is pre-compressed to a sufficient degree. During the subsequent forward stroke of the feeding piston, the steeply dropping flank increases the transporting ability of the feeding piston which is exerted substantially only be means of the front piston surface 10 of the feeding piston when the front flank is flat.

Figure 4:
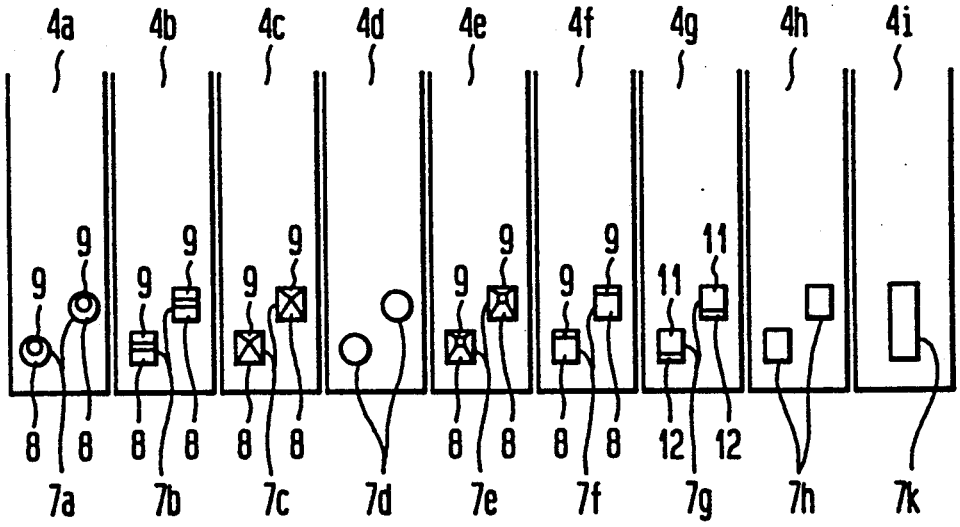
FIG. 4 shows a top view of a modified embodiment form corresponding to FIG. 3.

In accordance with the view in FIGS. 2 to 4, the retaining and compression bodies 7 can have different constructions. The drawing shows some examples of different possibilities of construction of the retaining and compression bodies on the individual feeding pistons, which are arranged adjacent to one another on the feed table 3, although in practice a single embodiment form for all feeding pistons is preferably selected for one feed device.

The individual feeding pistons are provided with the reference number 4 and an additional letter and the retaining bodies are provided with the reference number 7 and an additional letter for the purpose of explaining the different constructions. Nine feeding pistons **4*a*–4*i*** are arranged in the shown embodiment example, wherein a different variant of a retaining and compression body is provided on each feeding piston.

On the feeding piston **4*a*, two retaining and compression bodies 7*a* which are constructed in the manner of a cone frustum are provided in the vicinity of the front edge of the feeding piston 4*a*; as can be seen from FIG. 3, the flank 8 which is directed toward the front drops more gradually than the flank 9 directed toward the rear. This likewise applies to all the other embodiment forms, with the exception of the retaining and compression bodies 7*g* on the feeding piston 4*g*. Two identical retaining and compression bodies 7*b*, which are constructed as narrow bodies standing on edge, are provided in turn on the feeding piston 4*b*. The outer outline of these retaining and compression bodies 7*b* is shaped in a substantially trapezoidal manner as seen from the side, wherein the flank 8 directed toward the front also drops in a substantially more gradual manner than the flank 9** directed toward the rear end of the feeding piston.

The retaining and compression bodies **7*c* on the feeding piston 4*c* are constructed in the manner of a pyramid, while the retaining and compression bodies 7*d* on the feeding piston 4*d* are shaped as spherical shells. The retaining and compression bodies 7*e* on the feeding piston 4*e* are shaped in the manner of a pyramid frustum, wherein here, as in the rest of the retaining and compression bodies described previously, the flank 8 of this body which is directed toward the front drops in a substantially more gradual manner than the flank 9** which is directed toward the rear end of the feeding piston.

Flat retaining and compression bodies **7*f*, which are arranged so as to be on edge and comprise side walls which stand vertically relative to the piston surface, are arranged on the feeding piston 4*f* and are shaped triangularly as seen from the side with a front gradually dropping flank 8 and a flank 9 which drops steeply toward the rear. The retaining and compression bodies 7*h* on the feeding piston 4*h* are likewise shaped as flat bodies with arc-shaped outline. A single retaining and compression body 7*i* extending along the entire width of the feeding piston and comprising a triangular cross section with a flat front flank 8 and a steeper rear flank 9 is arranged on the feeding piston 4*i*. Flat retaining and compression bodies 7*h* which stand on edge and comprise a triangular outlines as seen from the side are arranged on the feeding piston 4*h* and, in contrast to the rest of the retaining bodies, the flank 11 directed toward the rear drops gradually and the flank 12** directed toward the front drops steeply.

The same retaining and compression bodies as in FIG. 3 are provided in FIG. 4 with one exception; however, these retaining bodies are offset relative to one another on one and the same feeding piston, so that two rows of retaining and compression bodies which are aligned relative to one another result with reference to all feeding pistons, while all retaining and compression bodies in the construction according to FIG. 3 are arranged so as to be aligned with one another. The feeding piston **4*i* in FIG. 4 carries only a single retaining and compression body 7*k*, but the latter is arranged with its longitudinal axis in the longitudinal direction of the feeding piston in contrast to the construction according to FIG. 3**. It has a rectangular outline as seen from the side.

While the foregoing description and drawings represent the preferred embodiments of the present invention, it will be obvious to those skilled in the art that various changes and modifications may be made therein without departing from the true spirit and scope of the present invention.

What is claimed is:

1. A feed device comprising: a filling hopper and adjoining feed chute, feeding pistons being provided at the lower end of the feed chute for conveying waste to an incineration plant, retaining and compression means being arranged on the upper side of at least one feeding piston for preventing waste fed into the filling hopper from sliding over the feed pistons in an uncontrolled manner and for compressing the waste.

2. A feed device according to claim 1, wherein said retaining and compression means is provided in the area of the front ends of the feeding pistons.

3. A feed device according to claim 1 or 2, wherein said retaining and compression means is provided directly at the front end of the feeding pistons.

4. A feed device comprising: a filling hopper and adjoining feed chute, feeding pistons being provided at the lower end of the feed chute for conveying waste to an incineration plant, wherein a plurality of retaining and compression bodies are arranged on every feeding piston for preventing waste fed into the feeding hopper from sliding over the feed pistons in an uncontrolled manner and for compressing the waste.

5. A feed device according to claim 4, wherein said retaining and compression bodies are arranged adjacent to one another.

6. A feed device according to claim 4, wherein the retaining and compression bodies are arranged so as to be offset relative to one another.

7. A feed device according to claim 1, wherein said retaining and compression body of a feeding piston is constructed as a means extending along the entire width of the feeding piston.

8. A feed device comprising: a filling hopper and adjoining feed chute, feeding pistons being provided at the lower end of the feed chute for conveying waste to an incineration plant, and wherein retaining and compression bodies arranged on adjacent feeding pistons are offset relative to one another preventing waste fed into the feeding hopper from sliding over the feed pistons in an uncontrolled manner and for compressing the waste.

9. A feed device according to claim 1, wherein said retaining and compression means of adjacent feeding piston are aligned with one another.

10. A feed device according to claim 1, wherein said retaining and compression means comprises a steeply dropping flank toward the rear end of the feeding piston and a gradually dropping flank toward the front end of the feeding piston.

11. A feed device according to claim 1, wherein said retaining and compression means comprises a gradually dropping flank toward the rear end of the feeding piston and a more steeply dropping flank toward the front end of the feeding piston.

12. A feed device according to claim 1, wherein said retaining and compression means is shaped as a flat body arranged on edge with a rectangular outline as seen from the side.

13. A feed device according to claim 1, wherein said retaining and compression means is shaped as a flat body arranged on edge with a trapezoidal outline as seen from the side.

14. A feed device according to claim 1, wherein said retaining and compression means is shaped as a flat body arranged on edge with a triangular outline as seen from the side.

15. A feed device according to claim 1, wherein said retaining and compression means is shaped as a flat body arranged on edge with an arc-shaped outline as seen from the side.

16. A feed device according to claim 1, wherein said retaining and compression means is shaped in the manner of a pyramid or a pyramid frustum.

17. A feed device according to claim 1, wherein said retaining and compression means is shaped in the manner of a cone or a cone frustum.

18. A feed device according to claim 1, wherein said retaining and compression means is shaped in the manner of a spherical shell.

* * * * *

UNITED STATES PATENT AND TRADEMARK OFFICE

CERTIFICATE OF CORRECTION

PATENT NO. : 5,009,171

DATED : April 23, 1991

INVENTOR(S) : Johannes J.E. Martin et al

It is certified that error appears in the above-indentified patent and that said Letters Patent is hereby corrected as shown below:

On the title page, Item [73] change "fur Umeeld" to read — für Umwelt —.

Column 2, line 21: Change from "shape" to "shaped"

Column 2, line 31: Change from "drawings:" to "drawings,"

Claim 7, eolumn 5, line 8: Change from "body" to "means"

Claim 7, column 5, line 9: Change from "means" to "body"

Claim 9, column 5, line 21: Change from "piston" to "pistons"

Signed and Sealed this

Twelfth Day of October, 1993

Bruce Lehman

*Attest:*

BRUCE LEHMAN

*Attesting Officer*

*Commissioner of Patents and Trademarks*